US008585461B1

(12) United States Patent
Anderson

(10) Patent No.: US 8,585,461 B1
(45) Date of Patent: Nov. 19, 2013

(54) PRECISION COATING SANDER

(75) Inventor: Steven A. Anderson, St. Louis, MO (US)

(73) Assignee: The Boeing Company, Chicago, IL (US)

( * ) Notice: Subject to any disclaimer, the term of this patent is extended or adjusted under 35 U.S.C. 154(b) by 677 days.

(21) Appl. No.: 12/816,469

(22) Filed: Jun. 16, 2010

(51) Int. Cl.
*B24B 1/00* (2006.01)

(52) U.S. Cl.
USPC ..... 451/28; 451/29; 451/51

(58) Field of Classification Search
USPC ..... 451/28, 29, 51
See application file for complete search history.

(56) References Cited

U.S. PATENT DOCUMENTS 2,629,210 A * 2/1953 Robinson ..... 451/353
3,596,411 A 8/1971 Hutchins
3,958,491 A * 5/1976 Habib ..... 409/211
4,334,390 A 6/1982 Sumerau
4,566,511 A 1/1986 Robinson
4,614,063 A * 9/1986 Crivaro et al. ..... 451/350
4,628,641 A 12/1986 Lazzari
5,103,599 A 4/1992 Carlson
5,140,778 A * 8/1992 Carruth ..... 451/344
5,140,784 A 8/1992 Walsh

* cited by examiner

*Primary Examiner* — Lee D Wilson
*Assistant Examiner* — Shantese McDonald
(74) *Attorney, Agent, or Firm* — Yee & Associates, P.C.

(57) ABSTRACT

A method and apparatus for sanding a workpiece. A sanding apparatus may be positioned relative to a surface of the workpiece. A positioning structure for the sanding apparatus may be moved relative to a frame for the sanding apparatus. A sanding system for the sanding apparatus may be held at a range of heights and a range of angles relative to the surface of the workpiece, while the sanding system operates. The sanding apparatus may be operated to sand the surface of the workpiece.

24 Claims, 14 Drawing Sheets

PRECISION COATING SANDER

BACKGROUND INFORMATION

1. Field

The present disclosure relates generally to manufacturing and, in particular, to a method and apparatus for sanding the surface of an object.

2. Background

In manufacturing objects, different operations may be performed on a workpiece to produce an object. For example, operations, such as drilling, cutting, routing, sanding, and/or other suitable operations, may be performed on a workpiece.

Sanding may be performed to smooth surfaces. Additionally, sanding may be performed to remove portions of a surface. Additionally, sanding also may be performed to create changes in the surface. For example, without limitation, beveled edges may be created in a surface of a workpiece. A layer in a workpiece may be partially or completely removed through sanding of the layer. For example, a coating or layer of paint may be removed to expose other layers. When removing a layer, such as paint, it may be desirable to remove that layer without removing portions of layers below the layer of paint.

As another example, with a workpiece made of composite materials, different layers may be present. It may be desirable to remove or change the thickness of a top layer without affecting layers below the top layer.

This type of removal of a layer may be performed by hand sanding or scraping. In other instances, the layer may be removed through an electrical or pneumatically-powered sander.

These types of operations may be time consuming and labor intensive. As a result, the processing of workpieces may occur more slowly than desired.

Therefore, it would be advantageous to have a method and apparatus that takes into account the issues discussed above, as well as other possible issues.

SUMMARY

In one advantageous embodiment, an apparatus may comprise a sanding system, a frame, and a positioning structure connected to the frame and the sanding system. The positioning structure may be configured to move relative to the frame and hold the sanding system at a range of heights and a range of angles relative to a surface of a workpiece, while the sanding system operates.

In another advantageous embodiment, a sanding apparatus may comprise a sanding system, a first frame, a positioning structure connected to the first frame and the sanding system, an interface, and an indication system. The sanding system may comprise a cylinder having a surface, an abrasive material on the surface of the cylinder, and a motor configured to rotate the cylinder about an axis extending through the cylinder. The sanding system may comprise at least one of a rotary sander, a drum sander, a router, and a disk sander. The axis extending through the cylinder for the sanding system may be at a substantially right angle to a movement of the first frame. The positioning structure may be configured to move relative to the first frame and hold the sanding system at a range of heights and a range of angles relative to a surface of a workpiece, while the sanding system operates. The positioning structure may comprise a second frame connected to the first frame, an angular adjustment system, and a translation system associated with the second frame. The second frame may be configured to rotate relative to the first frame and hold the sanding system at the range of angles. The angular adjustment system may be configured to rotate the second frame relative to the first frame to position the sanding system at the range of angles. The sanding system may be associated with the translation system and the translation system may be configured to hold the sanding system at the range of heights and to move the sanding system along an axis that is substantially perpendicular to a plane of the second frame. The interface may be on a side of the first frame and may be configured to contact the surface of the workpiece, while the sanding system operates. The interface may be selected from at least one of a plurality of feet and a plurality of rollers associated with the side of the first frame. The indication system may be configured to indicate a height at which the sanding system may operate relative to the surface of the workpiece.

In yet another advantageous embodiment, a method for sanding a workpiece may be provided. A sanding apparatus may be positioned relative to a surface of the workpiece. A positioning structure for the sanding apparatus may be moved relative to a frame for the sanding apparatus. A sanding system for the sanding apparatus may be held at a range of heights and a range of angles relative to the surface of the workpiece, while the sanding system operates. The sanding apparatus may be operated to sand the surface of the workpiece.

In still yet another advantageous embodiment, a method for sanding a workpiece may be provided. A sanding apparatus may be positioned relative to a surface of the workpiece. The sanding apparatus may comprise a sanding system, a first frame, and a positioning structure associated with the first frame and the sanding system. The positioning structure may be configured to move relative to the first frame and hold the sanding system at a range of heights and a range of angles relative to the surface of the workpiece, while the sanding system operates. A second frame in the positioning structure may be rotated relative to a plane through the first frame to hold the sanding system at an angle in the range of angles. A translation system in the positioning structure may be used to hold the sanding system at a height in the range of heights. The sanding apparatus may be operated to sand the workpiece in which at least a portion of an outer layer for the workpiece may be removed while sanding the workpiece.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

Figure 1:
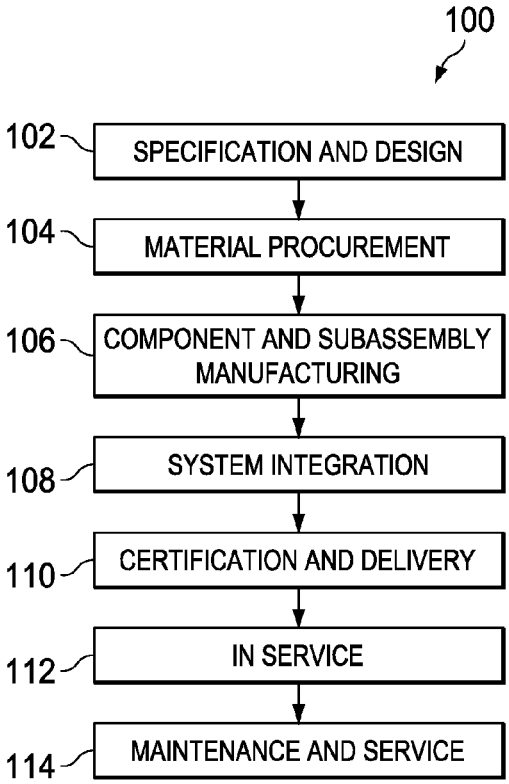
FIG. 1 is an illustration of an aircraft manufacturing and service method in accordance with an advantageous embodiment.
Figure 2:
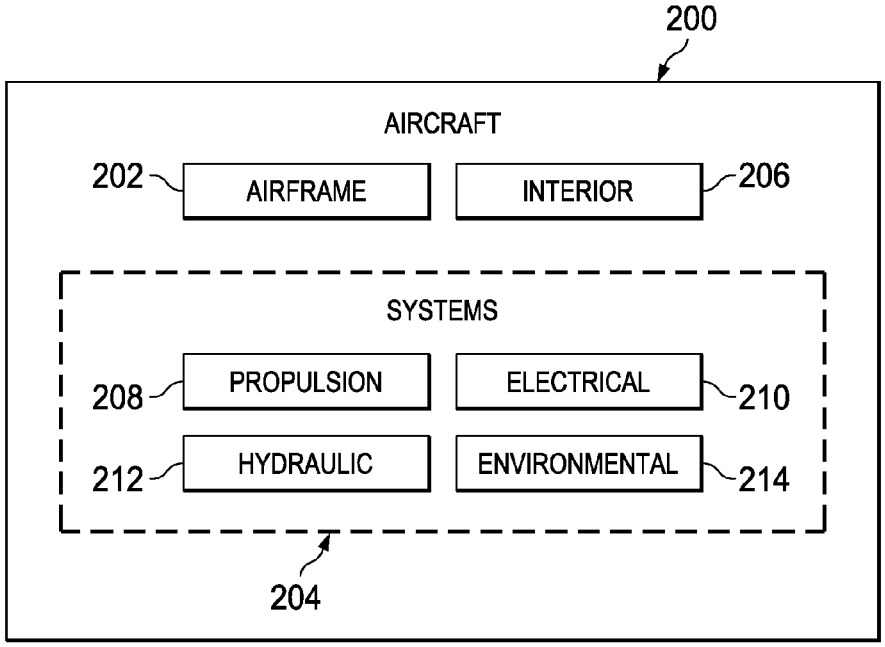
FIG. 2 is an illustration of an aircraft in which an advantageous embodiment may be implemented.

Referring more particularly to the drawings, embodiments of the disclosure may be described in the context of aircraft manufacturing and service method 100 as shown in FIG. 1 and aircraft 200 as shown in FIG. 2. Turning first to FIG. 1, an illustration of an aircraft manufacturing and service method is depicted in accordance with an advantageous embodiment. During pre-production, aircraft manufacturing and service method 100 may include specification and design 102 of aircraft 200 in FIG. 2 and material procurement 104.

During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service 112 by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, an illustration of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during at least one of the stages of aircraft manufacturing and service method 100 in FIG. 1. As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C or item B and item C.

In one illustrative example, components or subassemblies produced in component and subassembly manufacturing 106 in FIG. 1 may be fabricated or manufactured in a manner similar to components or subassemblies produced while aircraft 200 is in service 112 in FIG. 1. As yet another example, a number of apparatus embodiments, method embodiments, or a combination thereof may be utilized during production stages, such as component and subassembly manufacturing 106 and system integration 108 in FIG. 1.

A number, when referring to items, means one or more items. For example, a number of apparatus embodiments is one or more apparatus embodiments. A number of apparatus embodiments, method embodiments, or a combination thereof may be utilized while aircraft 200 is in service 112 and/or during maintenance and service 114 in FIG. 1. The use of a number of the different advantageous embodiments may substantially expedite the assembly of and/or reduce the cost of aircraft 200.

The different advantageous embodiments recognize and take into account a number of different considerations. For example, the different advantageous embodiments recognize and take into account that consistency and/or quality issues may be present when using sanding techniques, such as hand sanding or hand scraping. Additionally, the use of pneumatic or electrical sanders to perform sanding also may result in workmanship or quality issues.

For example, the different advantageous embodiments recognize and take into account that in some cases, the layers in a workpiece may have a thickness such that the positioning of a sander or hand sanding may not provide a desired amount of sanding. For example, too much material may be removed such that a layer below the top layer being removed also may be partially or entirely removed. As a result, reworking of the workpiece may be required. In some cases, the workpiece may be discarded, and a new workpiece may be formed.

In some cases, the area of sanding may take up a large enough area that makes sanding with the amount of precision desired difficult or impossible. For example, the sanding may be performed for distances of about two to three feet or about 15 to 20 feet. The amount of material removed over these distances may be hundreds or thousands of inches. As a result, an operator performing sanding operations may not be able to remove the amount of material with the precision desired. In other cases, the amount of time needed to remove material may reduce the rate at which workpieces can be processed.

Thus, the different advantageous embodiments may provide a method and apparatus for sanding workpieces. In one advantageous embodiment, an apparatus may comprise a sanding system, a frame, and a positioning structure. The positioning structure may be associated with the frame and the sanding system. The positioning structure may be configured to move relative to the frame and hold the sanding system at a range of heights and a range of angles relative to the surface of a workpiece, while the sanding system operates.

Figure 3:
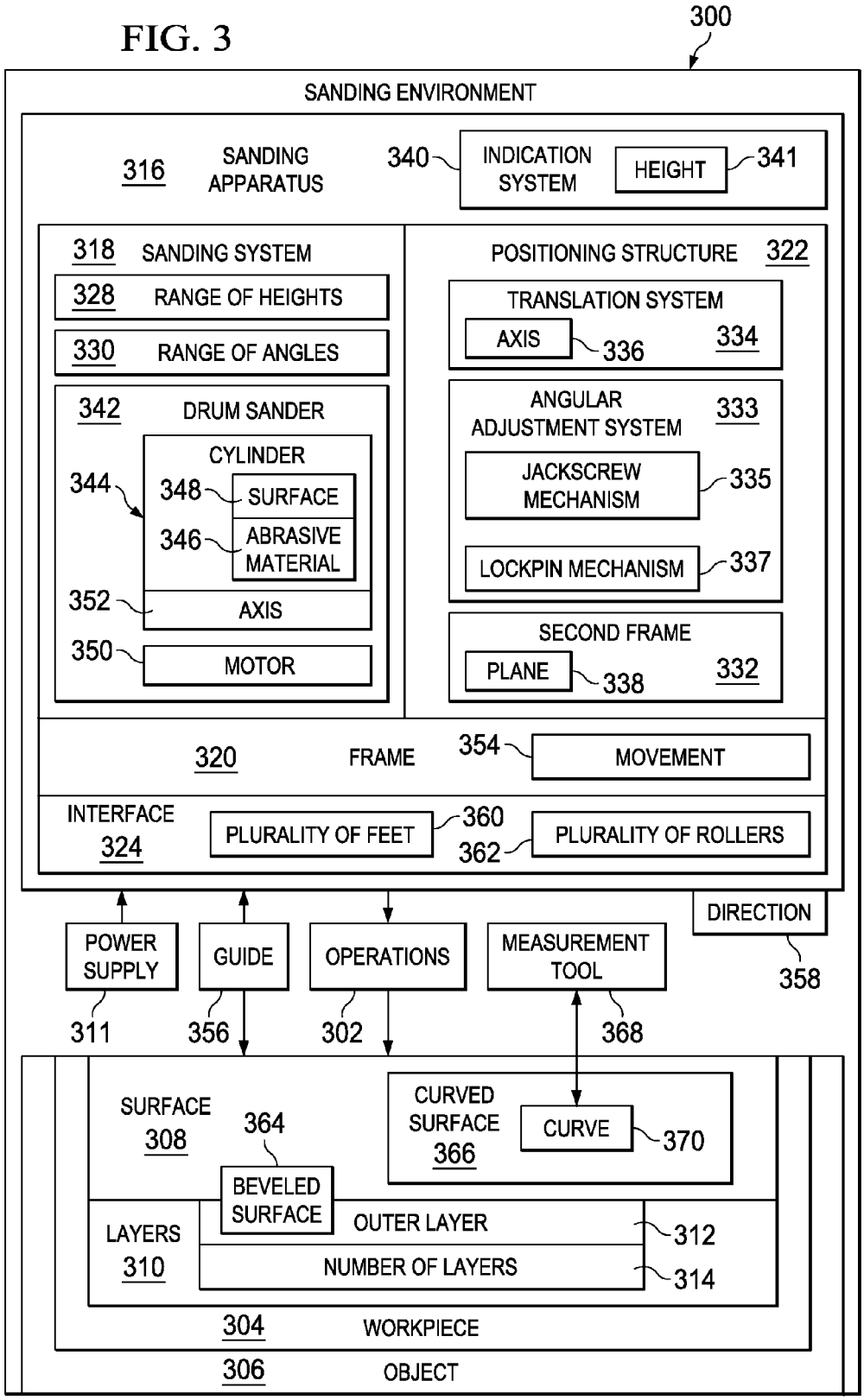
FIG. 3 is an illustration of a sanding environment in accordance with an advantageous embodiment.

With reference now to FIG. 3, an illustration of a sanding environment is depicted in accordance with an advantageous embodiment. Sanding environment 300, in these examples, may be used to perform operations 302 on workpiece 304. Workpiece 304 may form various components for a platform, such as aircraft 200 in FIG. 2. For example, workpiece 304 may be, for example, without limitation, a wing, a stabilizer, a flap, a portion of a fuselage, an engine inlet, a monument, and other suitable objects.

Operations 302 performed on workpiece 304 may form object 306. In these illustrative examples, operations 302 may be performed on surface 308 of workpiece 304. Workpiece 304 may comprise layers 310. Surface 308 may be part of outer layer 312 in layers 310. It may be desirable to perform operations 302 on outer layer 312 to remove at least a portion of outer layer 312 without removing number of layers 314 in layers 310 inside of outer layer 312.

In these illustrative examples, operations 302 may be performed using sanding apparatus 316. Sanding apparatus 316 may comprise sanding system 318, frame 320, positioning structure 322, and interface 324. Sanding apparatus 316 may be attached to power supply 311. Power supply 311 may provide power to perform operations 302.

In these illustrative examples, positioning structure 322 may be associated with frame 320 and sanding system 318. A first component may be considered to be associated with a second component by being secured to the second component, attached to the second component, bonded to the second component, fastened to the second component, mounted to the second component, and/or connected to the second component in some other suitable manner. The first component also may be connected to the second component by using a third component. The first component may be considered to be associated with the second component by being formed as part of and/or an extension of the second component.

Positioning structure 322 may be configured to move relative to frame 320. Further, positioning structure 322 may hold sanding system 318 at range of heights 328 and range of angles 330 relative to surface 308 of workpiece 304, while sanding system 318 performs operations 302.

In these illustrative examples, positioning structure 322 may comprise second frame 332, angular adjustment system 333, and translation system 334. Second frame 332 may be attached to frame 320. Second frame 332 may be configured to rotate relative to frame 320 and hold sanding system 318 at range of angles 330. In this illustrative example, angular adjustment system 333 may be configured to rotate second frame 332 relative to frame 320 to position sanding system 318 at range of angles 330.

In this depicted example, angular adjustment system 333 may take a number of different forms. For example, without limitation, angular adjustment system 333 may take the form of jackscrew mechanism 335, lockpin mechanism 337, and/or some other suitable mechanism for rotating second frame 332 relative to frame 320.

Translation system 334 may be configured to move sanding system 318 along axis 336. Axis 336 may be substantially perpendicular to plane 338 of second frame 332.

Additionally, sanding apparatus 316 also may have indication system 340. Indication system 340 may be configured to indicate height 341 at which sanding system 318 may operate relative to surface 308 of workpiece 304.

In these illustrative examples, sanding system 318 may be implemented using a number of different systems. For example, without limitation, sanding system 318 may comprise at least one of a rotary sander, a router, a disk sander, a drum sander, and other suitable types of tools that may perform sanding operations.

As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C, or item B and item C.

In these illustrative examples, a sanding operation may remove material from workpiece 304. This removal of material may be performed to change surface 308. The changing of surface 308 may include, for example, without limitation, creating a smoother surface, changing an angle of a surface, creating a bevel in the surface, creating a groove in the surface, or other suitable changes.

In this illustrative example, sanding system 318 may take the form of drum sander 342. As depicted, drum sander 342 may comprise cylinder 344 with abrasive material 346 on surface 348 of cylinder 344. Drum sander 342 also may comprise motor 350. Motor 350 may be configured to rotate cylinder 344 about axis 352 extending through cylinder 344. In these examples, axis 352 may be at a substantially right angle to direction 358 of movement 354 of frame 320 when frame 320 is moved during the performance of operations 302 on workpiece 304.

In these illustrative examples, in performing operations 302 on workpiece 304, guide 356 may guide movement 354 of sanding apparatus 316 in direction 358 on surface 308 of workpiece 304. Guide 356 may be placed on workpiece 304 in this example. In other illustrative examples, guide 356 may be attached to sanding apparatus 316.

In these illustrative examples, interface 324 may be selected from at least one of plurality of feet 360, plurality of rollers 362, and other suitable types of interfaces. Interface 324 may be configured to contact surface 308 of workpiece 304, while sanding system 318 operates.

In these illustrative examples, operations 302 may be performed to remove outer layer 312 and create beveled surface 364 on outer layer 312 or outer layer 312 and number of layers 314. Additionally, operations 302 may be performed to make other changes to surface 308 of workpiece 304. In the different illustrative examples, surface 308 may include outer layer 312, number of layers 314, or other layers that may become exposed on workpiece 304 during the performance of operations 302.

In these illustrative examples, surface 308 may take the form of curved surface 366. In this example, measurement tool 368 may be used to measure curve 370 in curved surface 366. The measurement of curve 370 may be used to select range of angles 330 in positioning structure 322 to perform operations 302 on workpiece 304.

In the different advantageous embodiments, range of angles 330 and/or range of heights 328 may be changed before performing operations 302 on workpiece 304. Further, range of angles 330 and/or range of heights 328 may be changed while performing operations 302 on workpiece 304.

For example, without limitation, performing operations 302 may be temporarily paused such that range of angles 330 and/or range of heights 328 may be changed while sanding.

The illustration of sanding environment 300 in FIG. 3 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some illustrative examples, sanding system 318 may include more than one sander. For example, sanding system 318 may include another drum sander in addition to drum sander 342. As another example, second frame 332 may be configured to rotate about different parts of frame 320.

Figure 4:
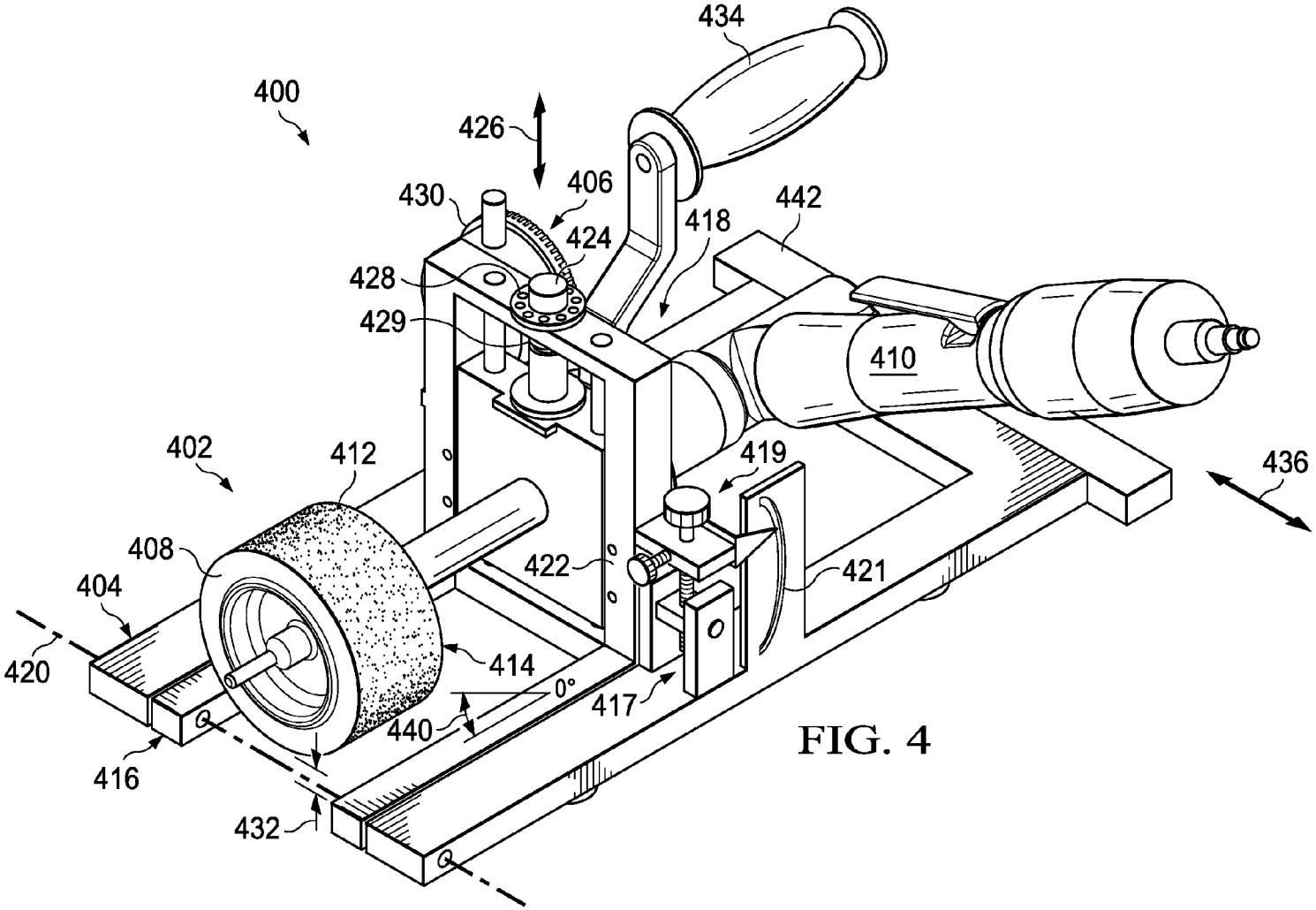
FIG. 4 is an illustration of a front perspective view of a sanding apparatus in accordance with an advantageous embodiment.

With reference now to FIG. 4, an illustration of a front perspective view of a sanding apparatus is depicted in accordance with an advantageous embodiment. Sanding apparatus 400 is an example of one implementation for sanding apparatus 316 in FIG. 3. As illustrated, sanding apparatus 400 may include sanding system 402, frame 404, and positioning structure 406.

As illustrated, sanding system 402 may comprise cylinder 408 and motor 410. Cylinder 408 may have abrasive material 412 on surface 414 of cylinder 408. In this example, motor 410 may be, for example, without limitation, a pneumatic motor, an electrical motor, or some other suitable type of motor.

As illustrated, positioning structure 406 may comprise second frame 416, angular adjustment system 417, and translation system 418. Second frame 416 may be connected to frame 404. As used herein, a first component "connected to" a second component means that the first component can be connected directly or indirectly to the second component. In other words, additional components may be present between the first component and the second component. When the first component is directly connected to the second component, no additional components are present between the two components.

In this illustrative example, positioning structure 406 may move relative to frame 404 and hold sanding system 402. Second frame 416 of positioning structure 406 may rotate relative to frame 404 about axis 420 in these examples. More specifically, angular adjustment system 417 may be configured to rotate second frame 416 relative to frame 404 about axis 420.

As depicted, angular adjustment system 417 may take the form of jackscrew mechanism 419 in this example. Jackscrew mechanism 419 may be used to rotate second frame 416 to position 440. Position 440 may be an angular position for sanding system 402.

Angular adjustment system 417 may be associated with angle indicator 421. Angle indicator 421 may indicate the angle for position 440. As depicted, position 440 for second frame 416 may be at substantially zero degrees relative to frame 404. In this depicted angle, angular adjustment system 417 may rotate second frame 416 to position 440 between about negative three degrees relative to frame 404 to about five degrees relative to frame 404.

In these illustrative examples, support member 422 may be associated with second frame 416. For example, support member 422 may be connected to or formed as part of second frame 416. As illustrated, sanding system 402 may be attached to second frame 416 through support member 422. In other words, sanding system 402 may be indirectly connected to second frame 416 through support member 422. Further, sanding system 402 may be indirectly connected to angular adjustment system 417 and translation system 418 through support member 422.

Translation system 418 may be configured to adjust the height of sanding system 402 by moving sanding system 402 in the direction of axis 426. As depicted, translation system 418 may include movable rod 424. Movable rod 424 may move sanding system 402 in the direction of axis 426. The adjustment of movable rod 424 may be performed through manipulation of dial 428. For example, without limitation, movable rod 424 may have threads 429 that allow movable rod 424 to move in the direction of axis 426 when turning dial 428.

Sanding apparatus 400 also may include indication system 430. Indication system 430 may indicate height 432 for sanding system 402 in these illustrative examples.

Also, as illustrated, sanding apparatus 400 may include handle 434. Handle 434 may be manipulated by an operator to move sanding apparatus 400. For example, sanding apparatus 400 may be moved in the direction of arrow 436 during the performing of sanding operations.

Additionally, movement of sanding apparatus 400 in the direction of arrow 436 may be guided using a guide, such as, for example, without limitation, guide 442. Guide 442 may be placed on the surface of the workpiece on which sanding apparatus 400 may perform operations.

Figure 5:
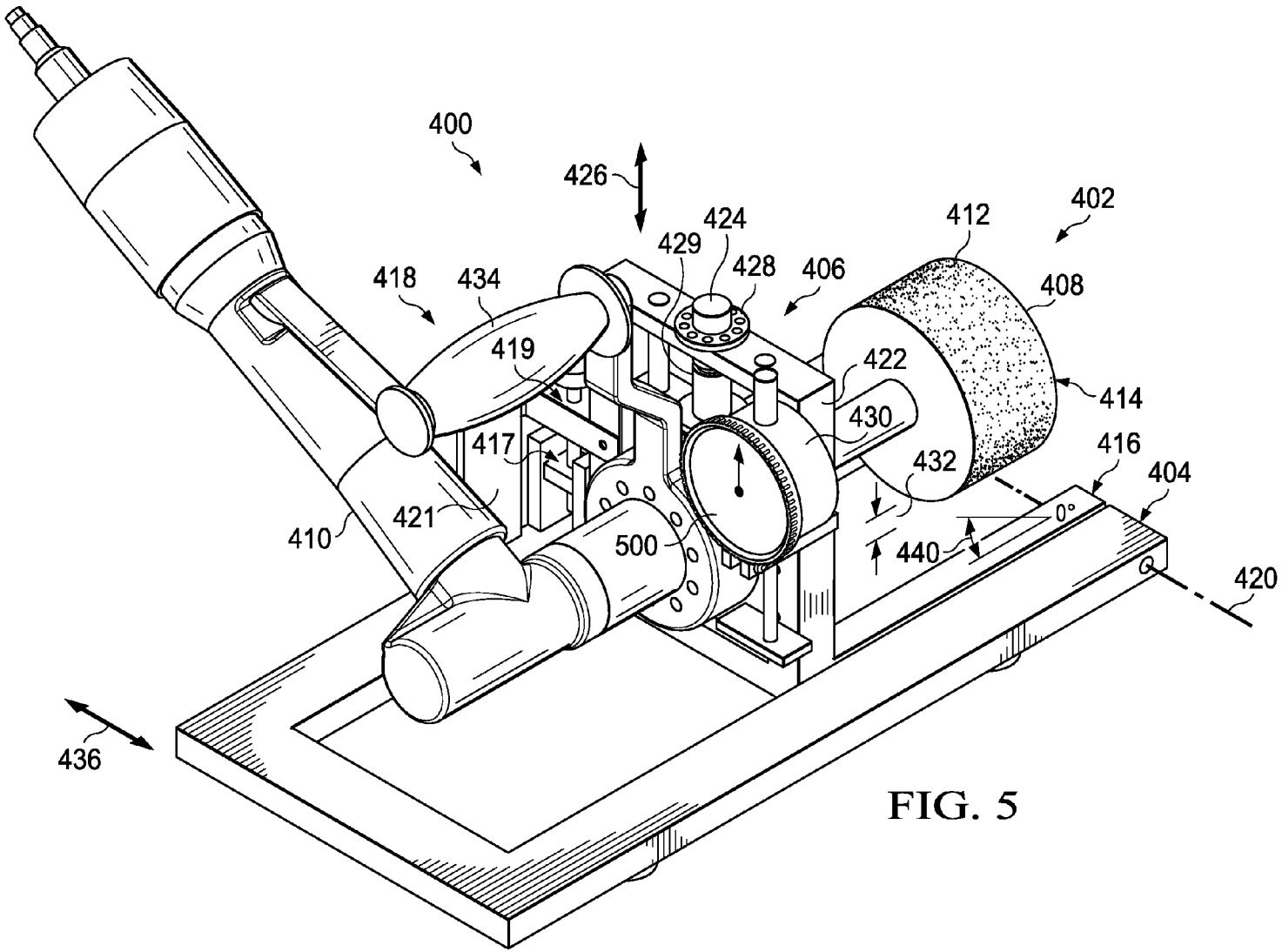
FIG. 5 is an illustration of a rear perspective view of a sanding apparatus in accordance with an advantageous embodiment.

With reference now to FIG. 5, an illustration of a rear perspective view of a sanding apparatus is depicted in accordance with an advantageous embodiment. In this illustrative example, sanding apparatus 400 is depicted from a different perspective view as compared to sanding apparatus 400 in FIG. 4.

In this depicted example, indication system 430 may indicate height 432 for sanding system 402 by indicating a value for height 432. As illustrated, indication system 430 may take the form of gauge 500 for measuring height 432.

Figure 6:
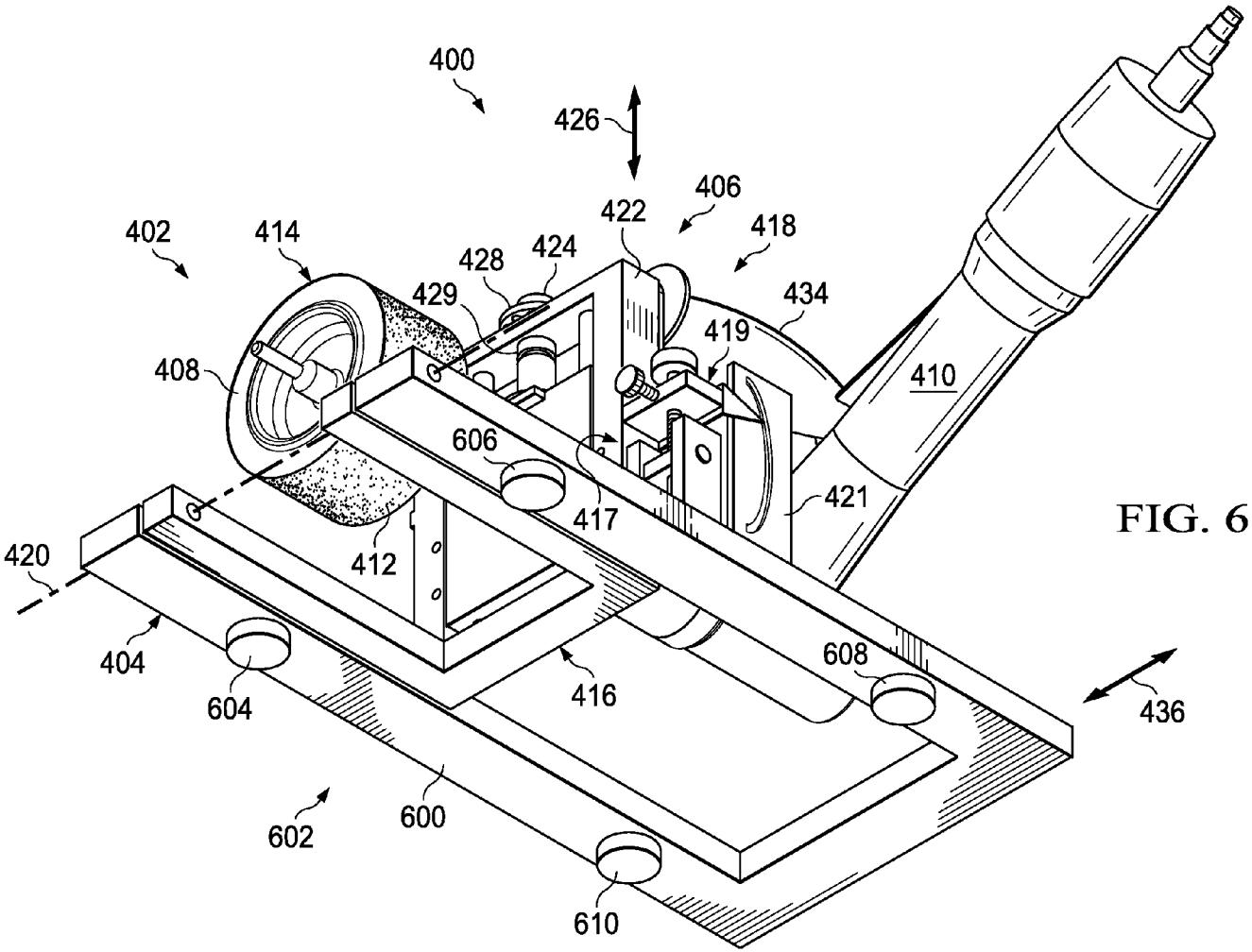
FIG. 6 is an illustration of a bottom perspective view of a sanding apparatus in accordance with an advantageous embodiment.

With reference now to FIG. 6, an illustration of a bottom perspective view of a sanding apparatus is depicted in accordance with an advantageous embodiment. In this illustrative example, bottom side 600 of sanding apparatus 400 is illustrated.

As depicted, plurality of feet 602 may be associated with bottom side 600 of sanding apparatus 400. Plurality of feet 602 may allow sanding apparatus to slide along a surface of a workpiece (not shown) when performing sanding operations.

In this depicted example, plurality of feet 602 include foot 604, foot 606, foot 608, and foot 610. In other examples, plurality of feet 602 may include some other number of feet.

In these illustrative examples, plurality of feet 602 may be comprised of a material selected such that plurality of feet 602 may not cause undesired effects on the surface of the workpiece during sanding operations. The material may be selected from at least one of Teflon®, nylon, rubber, and some other suitable type of material.

In other illustrative examples, a plurality of rollers, such as plurality of rollers 362 in FIG. 3, or some other suitable type of interface may be associated with bottom side 600 of sanding apparatus 400.

Figure 7:
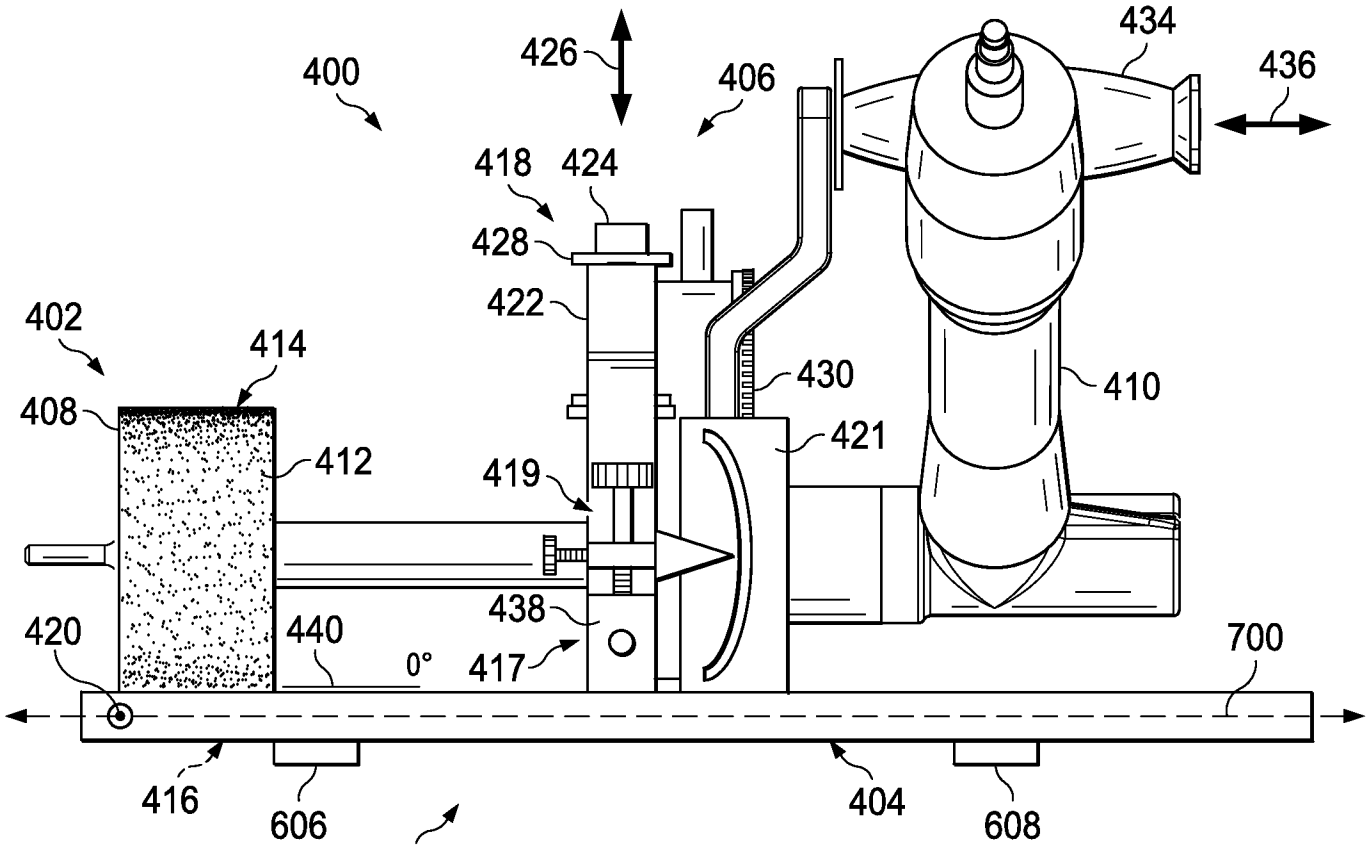
FIG. 7 is an illustration of a front view of a sanding apparatus in accordance with an advantageous embodiment.

With reference now to FIG. 7, an illustration of a front view of a sanding apparatus is depicted in accordance with an advantageous embodiment. In this illustrative example, second frame 416 may be in position 440 relative to frame 404.

In particular, second frame 416 may be at an angle of substantially zero degrees relative to plane 700 through frame 404 in position 440.

Figure 8:
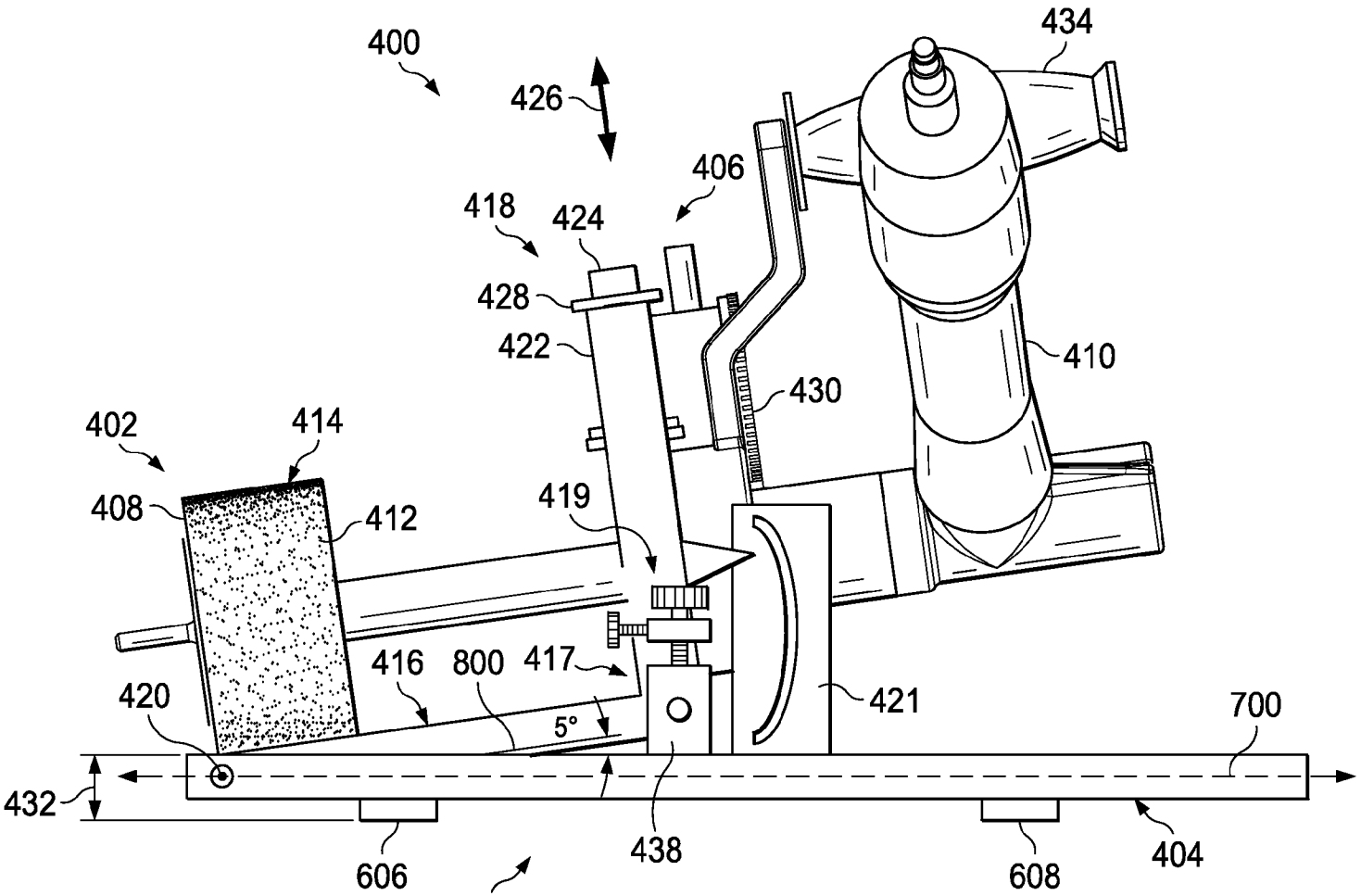
FIG. 8 is an illustration of a front view of a sanding apparatus in accordance with an advantageous embodiment.

With reference now to FIG. 8, an illustration of a front view of a sanding apparatus is depicted in accordance with an advantageous embodiment. In this illustrative example, second frame 416 may be in position 800 relative to frame 404. In position 800, second frame 416 may be at an angle of about five degrees relative to plane 700 through frame 404.

As illustrated, second frame 416 may be rotated about axis 420. Locking system 438 may hold second frame 416 in position 800 relative to frame 404 in this illustrative example.

Figure 9:
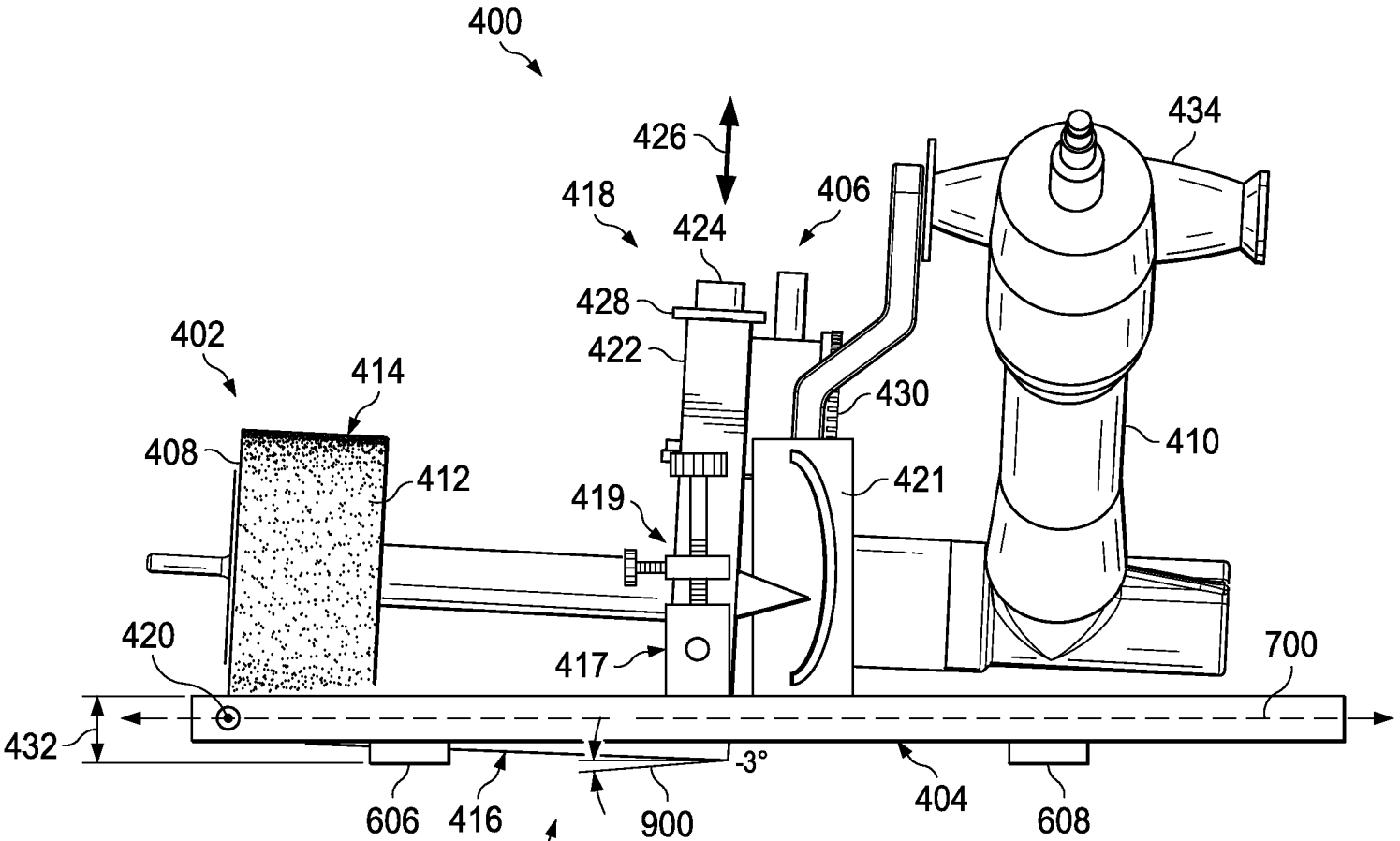
FIG. 9 is an illustration of a front view of a sanding apparatus in accordance with an advantageous embodiment.

With reference now to FIG. 9, an illustration of a front view of a sanding apparatus is depicted in accordance with an advantageous embodiment. In this illustrative example, angular adjustment system 417 may hold second frame 416 in position 900 relative to frame 404. As depicted, in position 900, second frame 416 may be at an angle of about negative three degrees relative to plane 700 through frame 404.

Figure 10:
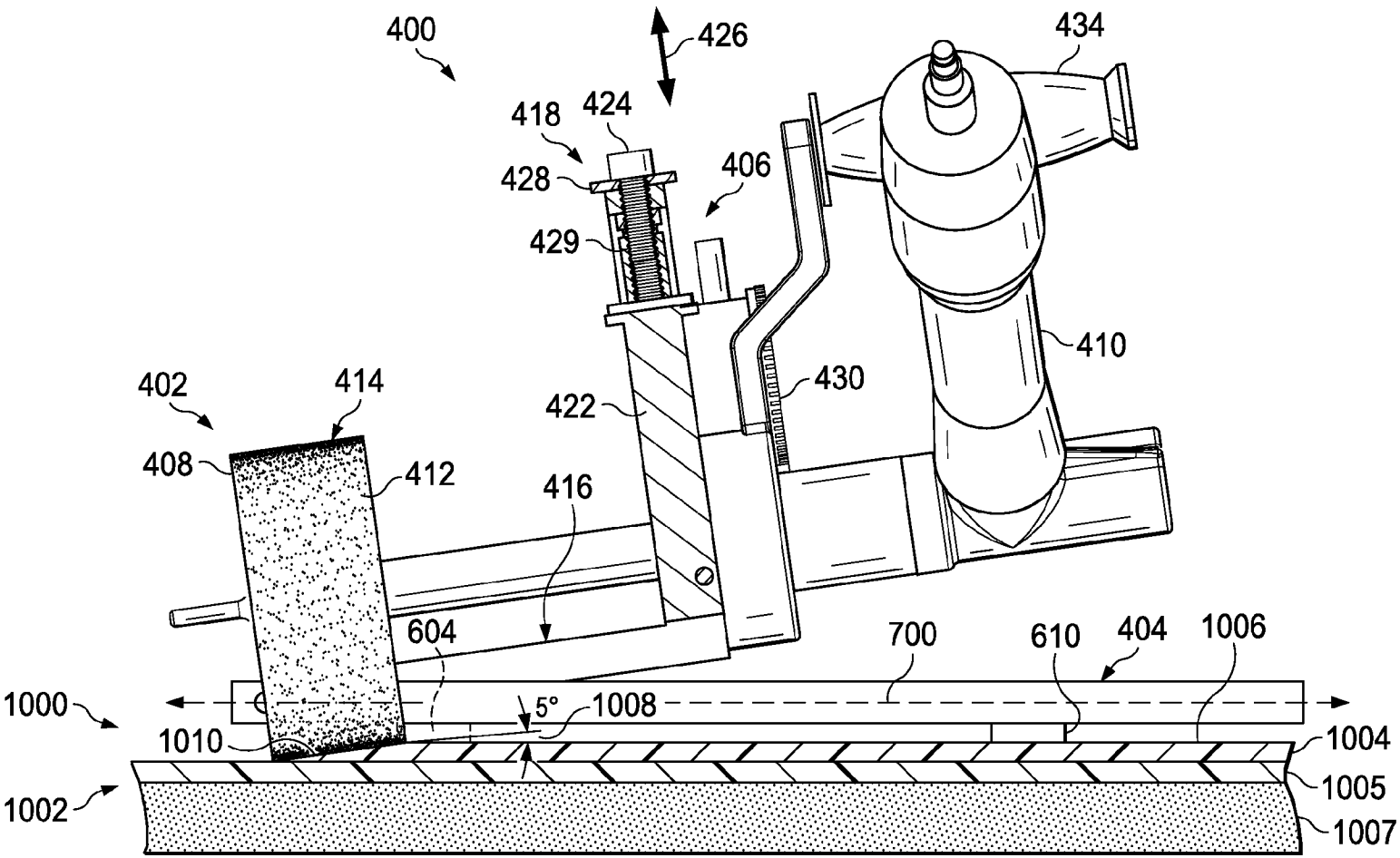
FIG. 10 is an illustration of a cross-sectional view of a sanding apparatus on a workpiece in accordance with an advantageous embodiment.

With reference now to FIG. 10, an illustration of a cross-sectional view of a sanding apparatus on a workpiece is depicted in accordance with an advantageous embodiment. In this illustrative example, sanding apparatus 400 may be used to perform sanding operations on workpiece 1000.

Workpiece 1000 may have layers 1002. Layers 1002 may include outer layer 1004, layer 1005, layer 1007, and additional layers. Outer layer 1004 and layer 1005 may be paint layers and/or some other suitable type of material. Layer 1007 may be comprised of a composite material, a metallic material, or some other suitable type of material. Sanding apparatus 400 may be placed on surface 1006 of outer layer 1004 to perform sanding operations.

In this illustrative example, second frame 416 of sanding apparatus 400 may be in position 1008. In position 1008, second frame 416 may be rotated to an angle of up to about five degrees relative to plane 700 through frame 404. In other illustrative examples, second frame 416 may be rotated to an angle of up to negative 3 degrees. Further, with second frame 416 in position 1008, sanding system 402 may create beveled surface 1010 for outer layer 1004 when performing the sanding operations on workpiece 1000.

Figure 11:
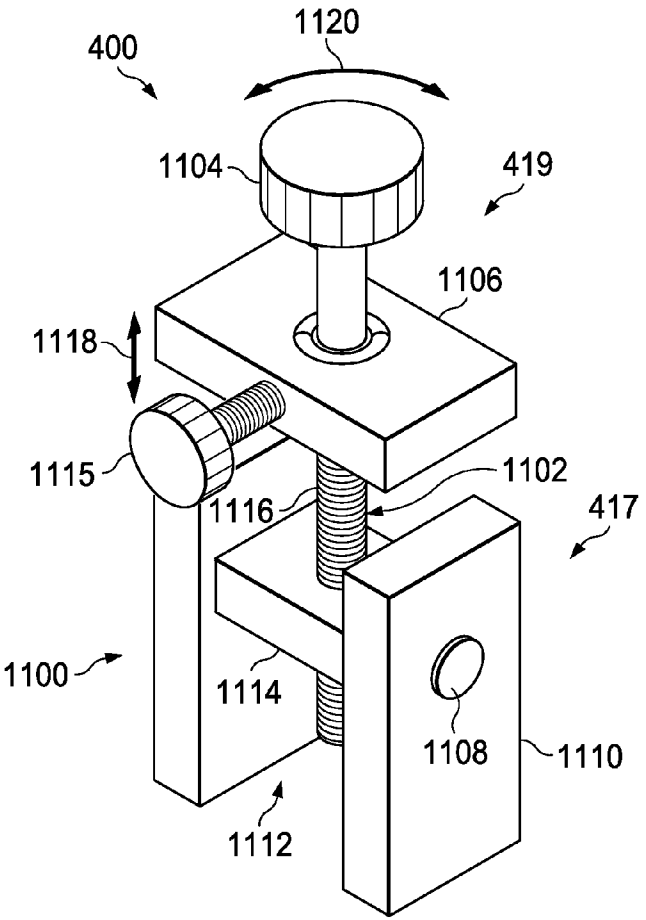
FIG. 11 is an illustration of an exploded view of an angular adjustment system in accordance with an advantageous embodiment.

With reference now to FIG. 11, an illustration of an exploded view of an angular adjustment system is depicted in accordance with an advantageous embodiment. In this illustrative example, angular adjustment system 417 may be depicted in the form of jackscrew mechanism 419.

Jackscrew mechanism 419 may include pivoting structure 1100, adjustment screw 1102, thumbscrew 1104, and bearing 1106. Pivoting structure 1100 may include pivot nut pin 1108, pivot block 1110, pivot block 1112, pivot nut 1114 and a second pivot nut pin (not shown). Pivot nut pin 1108 may connect pivot nut 1114 to pivot block 1110. The second pivot nut pin (not shown) may connect pivot nut 1114 to pivot block 1112.

As depicted, adjustment screw 1102 may have threads 1116 that allow adjustment screw 1102 to be moved in the direction of axis 1118 through pivot nut 1114. In particular, thumbscrew 1104 may be turned in the direction of arrow 1120 to move adjustment screw 1102 in the direction of axis 1118. Movement of adjustment screw 1102 may cause second frame 416 in FIG. 4 to be rotated relative to frame 404. In other words, movement of adjustment screw 1102 in the direction of axis 1118 may cause sanding system 402 to be held at a range of angles about axis 420 in these illustrative examples.

Additionally, jackscrew mechanism 419 may also include locking pin 1115. Locking pin 1115 may be used to lock the position of adjustment screw 1102 to hold sanding system 402 at the range of angles about axis 420. Of course, in other illustrative examples, some other suitable type of locking mechanism may be used to lock the position of adjustment screw 1102.

Figure 12:
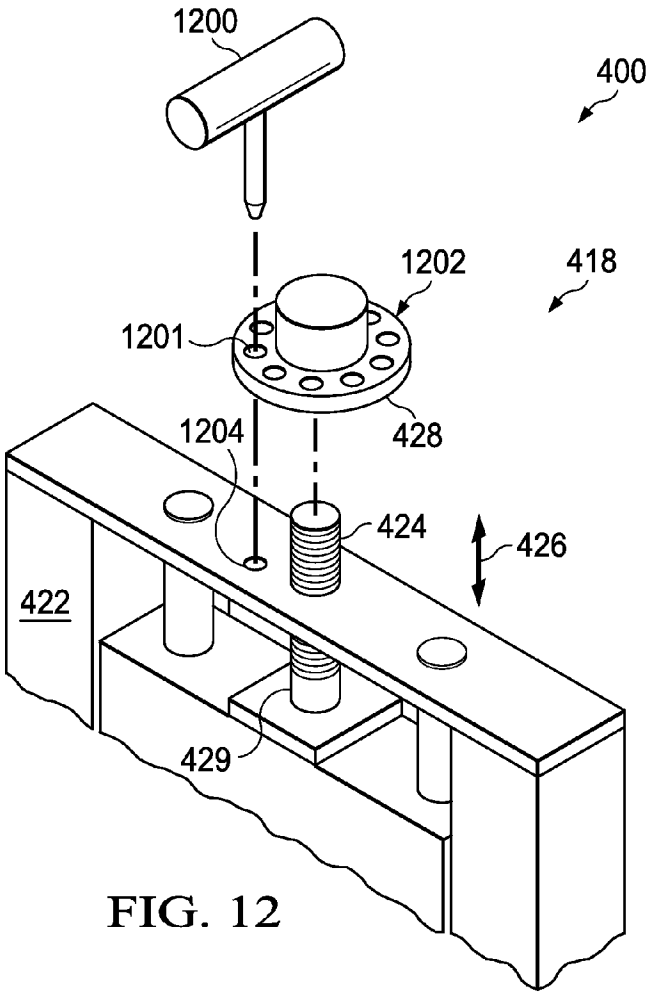
FIG. 12 is an illustration of an exploded view of a translation system in accordance with an advantageous embodiment.

With reference now to FIG. 12, an illustration of an exploded view of a translation system is depicted in accordance with an advantageous embodiment. In this illustrative example, translation system 418 may include dial 428, movable rod 424, and locking pin 1200.

Movable rod 424 may be moved in the direction of axis 426 through the manipulation of dial 428. Movement of movable rod 424 may cause sanding system 402 to move to adjust the height of sanding system 402 in FIG. 4.

At the desired height for sanding system 402, locking pin 1200 may be placed into hole 1201 in plurality of holes 1202 of dial 428. Further, locking pin 1200 may be placed through hole 1201 and through hole 1204 in support member 422 of sanding apparatus 400. In this manner, dial 428 may be locked in place such that the height of sanding system 402 may not change during the performing of sanding operations.

Of course, other types of locking systems may be used to lock dial 428 in place. For example, without limitation, dial 428 may be locked without the use of locking pin 1200. Dial 428 may be locked into place by pushing dial 428 or pulling on dial 428 in the direction of axis 426. As another example, dial 428 may be configured such that dial 428 may only be turned when dial 428 is pushed downwards.

The illustrations of sanding apparatus 400 in FIGS. 4-12 are not meant to imply physical or architectural limitations to the manner in which different advantageous embodiments may be implemented. Other components in addition to and/or in place of the ones illustrated may be used. Some components may be unnecessary in some advantageous embodiments.

Figure 13:
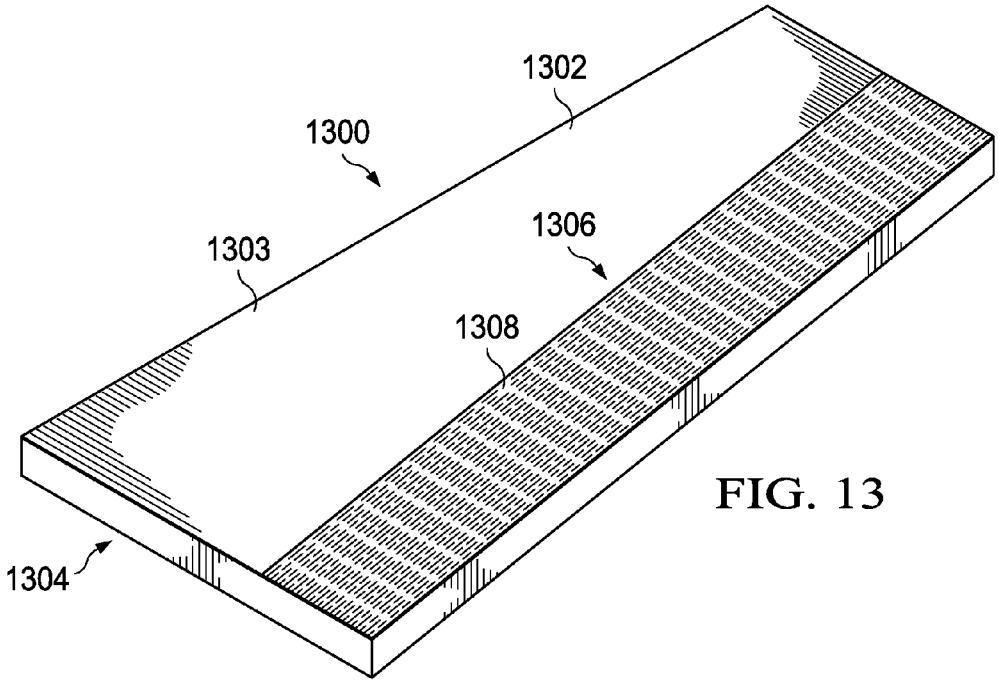
FIG. 13 is an illustration of a workpiece that has been sanded in accordance with an advantageous embodiment.

With reference now to FIG. 13, an illustration of a workpiece that has been sanded is depicted in accordance with an advantageous embodiment. In this illustrative example, workpiece 1300 may be an example of one implementation for workpiece 304 in FIG. 3.

As illustrated, workpiece 1300 may have surface 1302. Surface 1302 may be the surface of outer layer 1303 in layers 1304 for workpiece 1300.

Workpiece 1300 may have sanded portion 1306. Sanded portion 1306 of workpiece 1300 may have been sanded using a sanding apparatus, such as sanding apparatus 316 in sanding environment 300 in FIG. 3. In other words, outer layer 1303 may be removed from sanded portion 1306 of workpiece 1300. As illustrated, when outer layer 1303 is removed, layer 1308 in layers 1304 may be exposed in sanded portion 1306 of workpiece 1300.

The use of sanding apparatus 316 in FIG. 3 may not be limited to workpiece 1300 with layers 1304. Sanding apparatus 316 in FIG. 3 may be used with workpiece 1300 in which workpiece 1300 is a homogeneous structure made of only one type of material.

Figure 14:
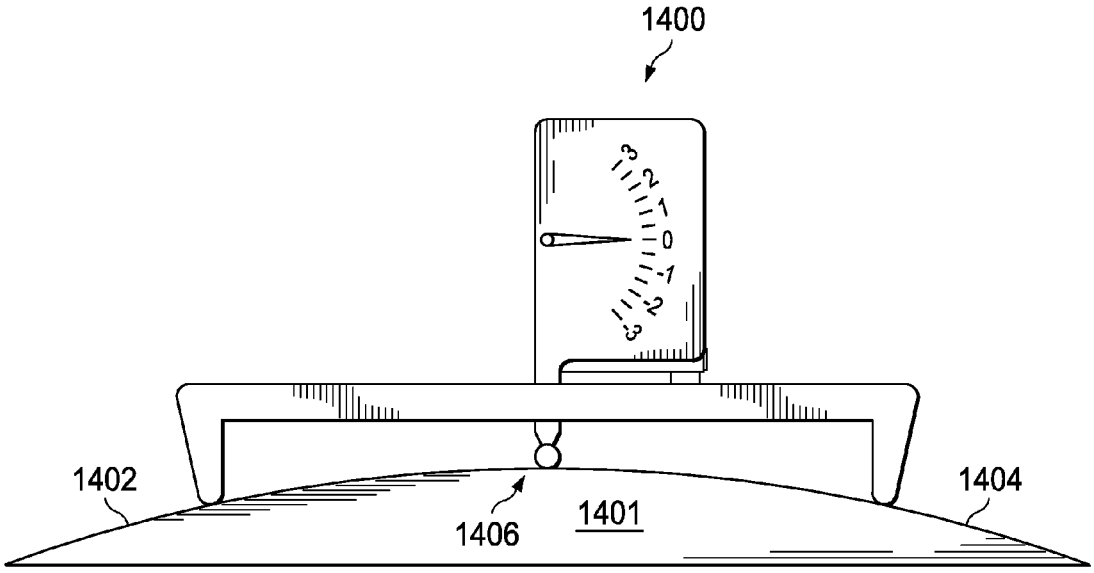
FIG. 14 is an illustration of a measurement tool in accordance with an advantageous embodiment.

With reference now to FIG. 14, an illustration of a measurement tool is depicted in accordance with an advantageous embodiment. In this illustrative example, measurement tool 1400 may be an example of one implementation for measurement tool 368 in FIG. 3.

As illustrated, measurement tool 1400 may be placed on workpiece 1401. Workpiece 1401 may have surface 1402. Surface 1402 may be curved surface 1404 in this illustrative example. In particular, curved surface 1404 may have a convex shape. Measurement tool 1400 may be used to measure curve 1406 in curved surface 1404. The measurement of curve 1406 may be used to select a range of angles for a sanding system, such as sanding system 402 in sanding apparatus 400 in FIGS. 4-12.

In other illustrative examples, sanding system 402 may comprise a spherical structure (not shown) in the place of cylinder 408. The spherical structure may be used to sand a curved surface with a concave shape as opposed to the convex shape for curved surface 1404.

Figure 15:
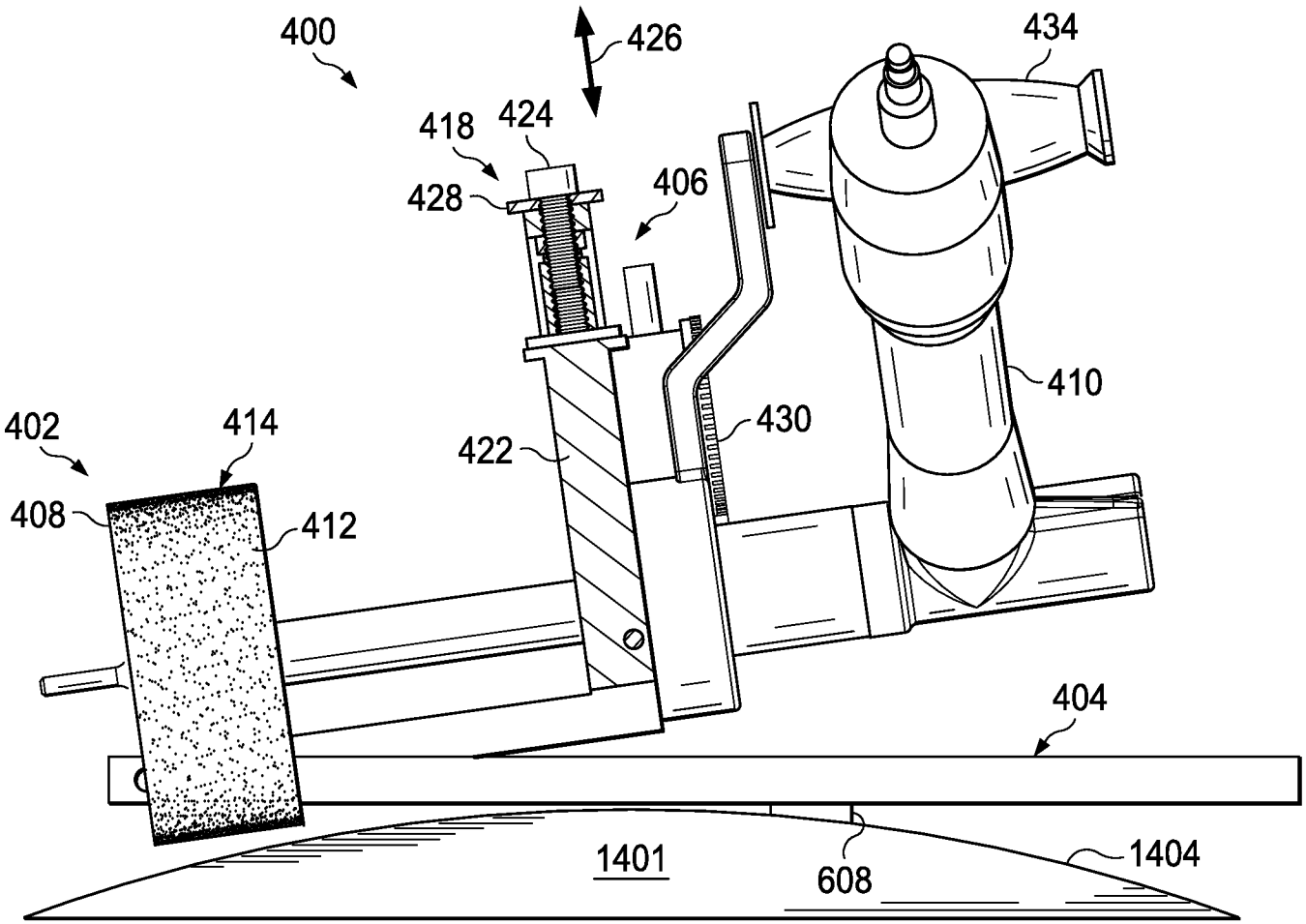
FIG. 15 is an illustration of a cross-sectional view of a sanding apparatus on a workpiece in accordance with an advantageous embodiment.

With reference now to FIG. 15, an illustration of a cross-sectional view of a sanding apparatus on a workpiece is depicted in accordance with an advantageous embodiment. In this illustrative example, sanding apparatus 402 in FIGS. 4-10 is depicted on workpiece 1401 in FIG. 14. Sanding apparatus 402 may be set at a range of angles selected using measurement tool 1400 (not shown) for sanding curved surface 1404.

Figure 16:
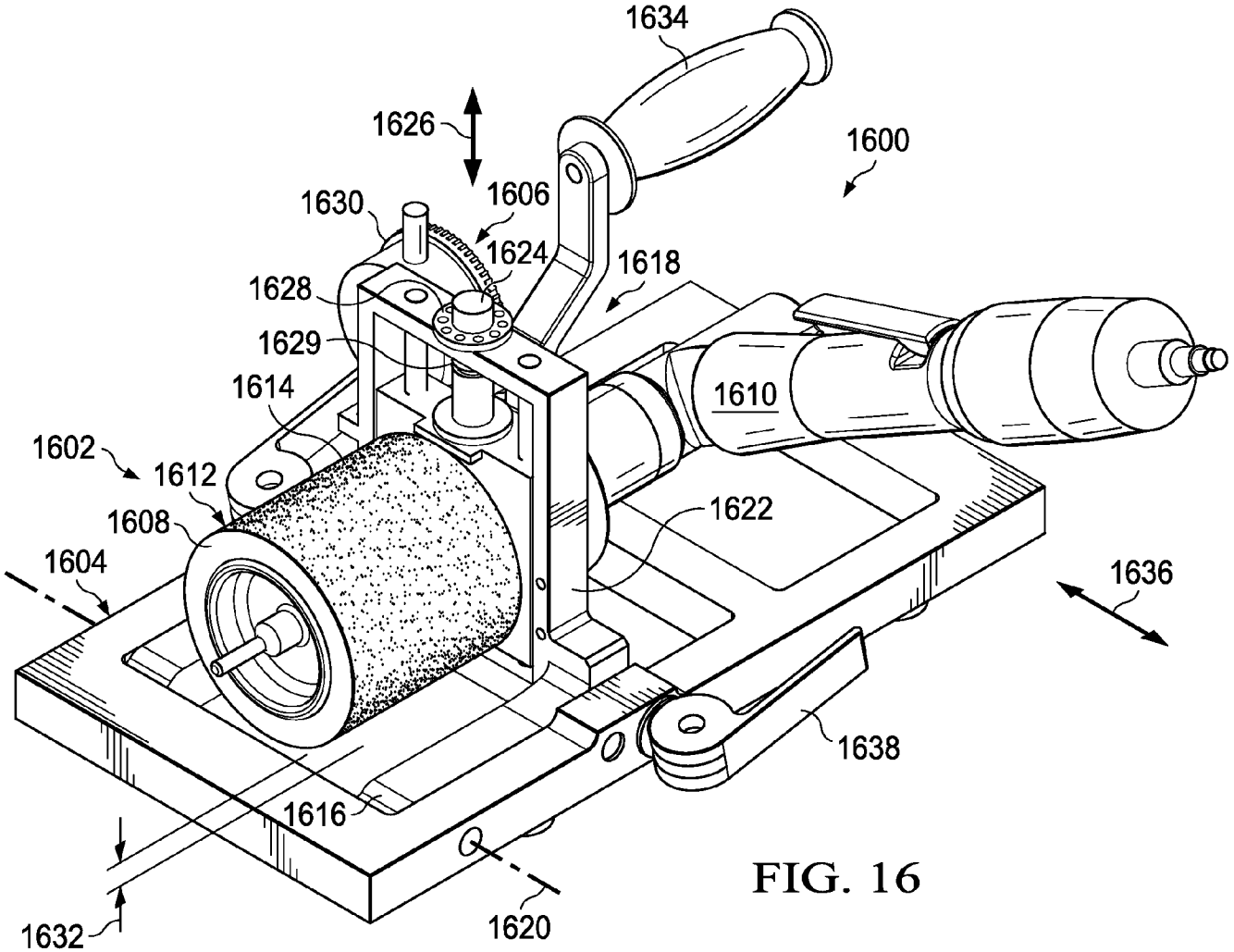
FIG. 16 is an illustration of a sanding apparatus in accordance with an advantageous embodiment.

With reference now to FIG. 16, an illustration of a sanding apparatus is depicted in accordance with an advantageous embodiment. Sanding apparatus 1600 is an example of one implementation for sanding apparatus 316 in FIG. 3. As illustrated, sanding apparatus 1600 may include sanding system 1602, frame 1604, and positioning structure 1606.

As illustrated, sanding system 1602 may comprise cylinder 1608 and motor 1610. Cylinder 1608 may have abrasive material 1612 on surface 1614 of cylinder 1608. In this example, motor 1610 may be, for example, without limitation, a pneumatic motor, an electrical motor, or some other suitable type of motor.

As illustrated, positioning structure 1606 may comprise second frame 1616 and translation system 1618. Second frame 1616 may be connected to frame 1604.

In this illustrative example, positioning structure 1606 may move relative to frame 1604 and hold sanding system 1602. Second frame 1616 of positioning structure 1606 may rotate relative to frame 1604 about axis 1620 in these examples.

In these illustrative examples, support member 1622 may be associated with second frame 1616. As illustrated, sanding system 1602 may be indirectly connected to second frame 1616 through support member 1622.

Translation system 1618 may include movable rod 1624. Movable rod 1624 may move sanding system 1602 in the direction of axis 1626. The adjustment of movable rod 1624 may be performed through manipulation of dial 1628. Movable rod 1624 may have threads 1629 that allow movable rod 1624 to move axially along the direction of axis 1626 when turning dial 1628.

Sanding apparatus 1600 also may include indication system 1630. Indication system 1630 may indicate height 1632 for sanding system 1602 in these illustrative examples.

Also, as illustrated, sanding apparatus 1600 may include handle 1634. Handle 1634 may be manipulated by an operator to move sanding apparatus 1600 in the direction of arrow 1636 during the performing of sanding operations.

Additionally, sanding apparatus 1600 also may include locking system 1638. Locking system 1638 may be configured to hold second frame 1616 at a number of angles. This number of angles may be fewer in number than the range of angles at which jackscrew mechanism 419 in FIG. 4 may allow second frame 416 to be held.

Figure 17:
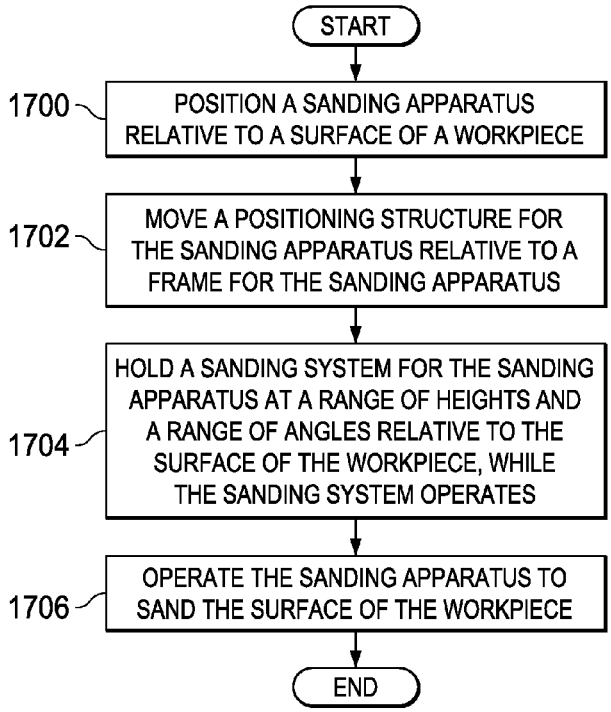
FIG. 17 is an illustration of a flowchart of a process for sanding a workpiece in accordance with an advantageous embodiment.

With reference now to FIG. 17, an illustration of a flowchart of a process for sanding a workpiece is depicted in accordance with an advantageous embodiment. The process illustrated in FIG. 17 may be implemented in sanding environment 300 in FIG. 3. In particular, the process may be implemented using sanding apparatus 316 in FIG. 3.

The process may begin by positioning sanding apparatus 316 relative to surface 308 of workpiece 304 (operation 1700). Sanding apparatus 316 may comprise sanding system 318, frame 320, positioning structure 322, and interface 324. Positioning structure 322 may be associated with frame 320 and sanding system 318.

The process may then move positioning structure 322 relative to frame 320 (operation 1702). Thereafter, the process may hold sanding system 318 at range of heights 328 and range of angles 330 relative to surface 308 of workpiece 304, while sanding system 318 operates (operation 1704).

Thereafter, the process may then operate sanding apparatus 316 to sand surface 308 of workpiece 304 (operation 1706), with the process terminating thereafter. Workpiece 304 may be sanded to change surface 308 of workpiece 304. For example, without limitation, workpiece 304 may be sanded to change a smoothness of surface 308, change a thickness of at least a portion of surface 308, or change surface 308 in some other suitable manner.

Figure 18:
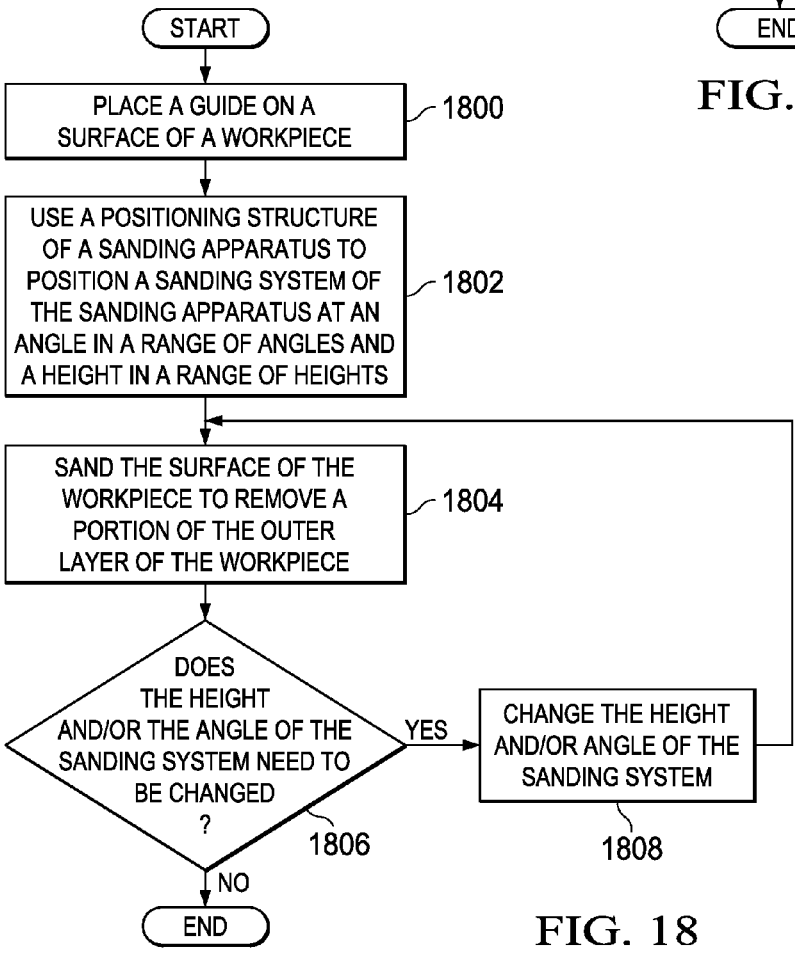
FIG. 18 is an illustration of a flowchart of a process for sanding a workpiece in accordance with an advantageous embodiment.

With reference now to FIG. 18, an illustration of a flowchart of a process for sanding a workpiece is depicted in accordance with an advantageous embodiment. The process illustrated in FIG. 18 may be implemented using sanding apparatus 316 in sanding environment 300 in FIG. 3.

The process may begin by placing guide 356 on surface 308 of workpiece 304 (operation 1800). Guide 356 may be placed in a position substantially parallel to an area on surface 308 to be sanded. The process may then use positioning structure 322 of sanding apparatus 316 to position sanding system 318 of sanding apparatus 316 at an angle in range of angles 330 and a height in range of heights 328 (operation 1802).

Thereafter, the process may sand surface 308 of workpiece 304 to remove a portion of outer layer 312 of workpiece 304 (operation 1804). The process may then determine whether the height and/or the angle of sanding system 318 needs to be changed (operation 1806).

If the height and/or angle of sanding system 318 needs to be changed, the process changes the height and/or angle of sanding system 318 (operation 1808), with the process returning to operation 1804 as described above. The height and/or angle of sanding system 318 may be changed such that sanding surface 308 of workpiece 304 at the new height and/or new angle creates beveled surface 364

With reference again to operation 1806, if the height and/or angle of sanding system 318 does not need to be changed, the process terminates. In performing operation 1808, a portion of outer layer 312 may be removed at an angle to create beveled surface 364.

In this illustrative example, operations 1804 and 1808 may be performed by moving sanding apparatus 316 over the area of surface 308 to be sanded using guide 356 a number of times. In other words, sanding apparatus 316 may be moved over the same area of surface 308 a number of times to remove the desired portion of outer layer 312.

The flowcharts and block diagrams in the different depicted embodiments illustrate the architecture, functionality, and operation of some possible implementations of apparatus and methods in different advantageous embodiments. In this regard, each block in the flowcharts or block diagrams may represent a module, segment, function, and/or a portion of an operation or step.

In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

Thus, the different advantageous embodiments may provide a method and apparatus for sanding workpieces. In one advantageous embodiment, an apparatus may comprise a sanding system, a frame, and a positioning structure. The positioning structure may be associated with the frame and the sanding system. The positioning structure may be configured to move relative to the frame and hold the sanding system at a range of heights and a range of angles relative to the surface of a workpiece, while the sanding system operates.

The different advantageous embodiments may provide a sanding apparatus that may reduce the time and/or effort needed to sand workpieces. Further, the different advantageous embodiments may provide a sanding apparatus that may allow a workpiece to be sanded with desired precision.

The description of the different advantageous embodiments has been presented for purposes of illustration and description and is not intended to be exhaustive or limited to the embodiments in the form disclosed. Many modifications and variations will be apparent to those of ordinary skill in the art.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a sanding system;

a frame; and a positioning structure connected to the frame and the sanding system in which the positioning structure is configured to move relative to the frame and hold the sanding system at a range of heights and a range of angles relative to a surface of a workpiece, while the sanding system operates on the surface of the workpiece.

2. The apparatus of claim 1 further comprising:

an interface on a side of the frame in which the interface is configured to contact the surface of the workpiece, while the sanding system operates on the surface of the workpiece.

3. The apparatus of claim 2, wherein the interface is selected from at least one of a plurality of feet and a plurality of rollers associated with the side of the frame.

4. The apparatus of claim 2, wherein the positioning structure is configured to hold the sanding system at the range of heights and the range of angles relative to the surface of the workpiece, while the sanding system operates, to form a beveled surface on at least a portion of the surface on the workpiece.

5. The apparatus of claim 1, wherein the frame is a first frame and wherein the positioning structure comprises:

a second frame connected to the first frame and configured to rotate relative to a plane through the first frame and parallel with the surface to position the sanding system at the range of angles; and a translation system associated with the second frame, wherein the sanding system is associated with the translation system and the translation system is configured to hold the sanding system at the range of heights.

6. The apparatus of claim 5, wherein the translation system is configured to move the sanding system along an axis that is substantially perpendicular to a plane of the second frame.

7. The apparatus of claim 5 further comprising:

an angular adjustment system configured to rotate the second frame relative to the first frame to position the sanding system at the range of angles.

8. The apparatus of claim 1 further comprising:

an indication system configured to indicate a height at which the sanding system operates relative to the surface of the workpiece.

9. The apparatus of claim 1, wherein the sanding system comprises:

a cylinder having a surface;

an abrasive material on the surface of the cylinder; and a motor configured to rotate the cylinder about an axis extending through the cylinder.

10. The apparatus of claim 9, wherein the axis is at a substantially right angle to a movement of the frame.

11. The apparatus of claim 1, wherein the sanding system comprises at least one of a rotary sander, a drum sander, a router, and a disk sander.

12. The apparatus of claim 1 further comprising:

a guide attached to the workpiece.

13. The apparatus of claim 1, wherein the surface is a curved surface selected from one of a convex surface and a concave surface and wherein the positioning structure is configured to hold the sanding system at the range of heights and the range of angles relative to the curved surface of the workpiece, while the sanding system operates.

14. A sanding apparatus comprising:

a sanding system comprising a cylinder having a surface; an abrasive material on the surface of the cylinder; and a motor configured to rotate the cylinder about an axis extending through the cylinder in which the sanding system comprises at least one of a rotary sander, a drum sander, a router, and a disk sander;

a first frame in which the axis extending through the cylinder for the sanding system is at a substantially right angle to a movement of the first frame;

a positioning structure connected to the first frame and the sanding system in which the positioning structure is configured to move relative to the first frame and hold the sanding system at a range of heights and a range of angles relative to a surface of a workpiece, while the sanding system operates, and in which the positioning structure comprises:

a second frame connected to the first frame and configured to rotate relative to the first frame and hold the sanding system at the range of angles;

an angular adjustment system configured to rotate the second frame relative to a plane through the first frame and parallel with the surface to position the sanding system at the range of angles; and a translation system associated with the second frame, in which the sanding system is associated with the translation system and the translation system is configured to hold the sanding system at the range of heights and to move the sanding system along an axis that is substantially perpendicular to a plane of the second frame;

an interface on a side of the first frame in which the interface is configured to contact the surface of the workpiece, while the sanding system operates, in which the interface is selected from at least one of a plurality of feet and a plurality of rollers associated with the side of the first frame; and an indication system configured to indicate a height at which the sanding system operates relative to the surface of the workpiece.

15. The sanding apparatus of claim 14, wherein the positioning structure is configured to hold the sanding system at the range of heights and the range of angles relative to the surface of the workpiece, while the sanding system operates on the surface of the workpiece, to form a beveled surface on at least a portion of the surface on the workpiece.

16. A method for sanding a workpiece, the method comprising:

positioning a sanding apparatus relative to a surface of the workpiece;

moving a positioning structure for the sanding apparatus relative to a frame for the sanding apparatus;

holding a sanding system for the sanding apparatus at a range of heights and a range of angles relative to the surface of the workpiece, while the sanding system operates on the surface of the workpiece; and operating the sanding apparatus to sand the surface of the workpiece.

17. The method of claim 16, wherein the sanding apparatus comprises the sanding system; the frame; and the positioning structure associated with the frame and the sanding system.

18. The method of claim 16, wherein the operating step comprises:

sanding a first portion of the surface of the workpiece with the sanding system at a first height in the range of heights and at a first angle in the range of angles;

changing at least one of the first height in the range of heights to a second height in the range of heights and the first angle in the range of angles to a second angle in the range of angles; and sanding a second portion of the surface of the workpiece with the sanding system after changing the at least one of the first height in the range of heights to the second height in the range of heights and the first angle in the range of angles to the second angle in the range of angles.

19. The method of claim 16, wherein the frame is a first frame and further comprising:

rotating a second frame in the positioning structure relative to a plane through the first frame to hold the sanding system at an angle in the range of angles.

20. The method of claim 16 further comprising:

using a translation system in the positioning structure to hold the sanding system at a height in the range of heights.

21. The method of claim 16, wherein the operating step comprises:

removing at least a portion of an outer layer for the workpiece.

22. The method of claim 16, wherein the operating step comprises:

sanding a portion of the workpiece with the sanding system at an angle in the range of angles to form a beveled surface in the portion of the workpiece.

23. A method for sanding a workpiece, the method comprising:

positioning a sanding apparatus relative to a surface of the workpiece in which the sanding apparatus comprises a sanding system; a first frame; and a positioning structure associated with the first frame and the sanding system in which the positioning structure is configured to move relative to the first frame and hold the sanding system at a range of heights and a range of angles relative to the surface of the workpiece, while the sanding system operates;

rotating a second frame in the positioning structure relative to a plane through the first frame to hold the sanding system at an angle in the range of angles;

using a translation system in the positioning structure to hold the sanding system at a height in the range of heights;

operating the sanding apparatus to sand the workpiece in which at least a portion of an outer layer for the workpiece is removed while sanding the workpiece.

24. The method of claim 23, wherein the operating step comprises:

sanding a first portion of the surface of the workpiece with the sanding system at a first height in the range of heights and at a first angle in the range of angles;

changing at least one of the first height in the range of heights to a second height in the range of heights and the first angle in the range of angles to a second angle in the range of angles; and sanding a second portion of the surface of the workpiece with the sanding system after changing the at least one of the first height in the range of heights to the second height in the range of heights and the first angle in the range of angles to the second angle in the range of angles.

* * * * *